United States Patent [19]

Eutebach

[11] Patent Number: 5,031,274

[45] Date of Patent: Jul. 16, 1991

[54] FLOOR DOOR LOCK

[75] Inventor: Peter Eutebach, Bad Salzuflen, Fed. Rep. of Germany

[73] Assignee: Dorma - Glas Gesellschaft fuer Glastuer, Bad Salzuflen, Fed. Rep. of Germany

[21] Appl. No.: 345,948

[22] Filed: May 1, 1989

[30] Foreign Application Priority Data

May 6, 1988 [DE] Fed. Rep. of Germany ... 8806052[U]

[51] Int. Cl.[5] ..... E05D 7/10

[52] U.S. Cl. ..... 16/229; 16/379; 16/382; 49/388

[58] Field of Search ..... 16/55, 229-231, 16/378, 379, 386, 382; 49/188, 189, 388

[56] References Cited

U.S. PATENT DOCUMENTS

| | | | |
|---|---|---|---|
| 815,011 | 3/1906 | Hanson | 16/250 |
| 1,169,283 | 1/1916 | Peterick | 16/378 |
| 2,933,756 | 4/1960 | Muessel | 16/229 |
| 2,955,314 | 10/1960 | Tylman | 16/229 |
| 3,114,942 | 12/1963 | Abedon et al. | 49/388 |
| 3,143,760 | 8/1964 | Ferguson | 16/229 |
| 3,145,414 | 8/1964 | Martin | 16/378 |
| 3,786,534 | 1/1974 | Ferguson | 16/229 |

*Primary Examiner*—Richard K. Seidel
*Assistant Examiner*—Edward A. Brown
*Attorney, Agent, or Firm*—Ralph H. Dougherty

[57] ABSTRACT

A floor door lock for restricting movement of a pivotal or sliding door relative to a floor, which inserts a lock pin into a pin-receiving opening in the floor. The door carriers an adapter fixed to its bottom side, the adapter having a chamber (42) therein, a pivotal arm (44) pivotally connected to the housing within the chamber, the lock pin connected to the bottom of the pivotal arm, and blocking means (46) for bearing against the arm (44) to retain the lock pin in the door-locking position in the receiving opening in the floor. The adapter arrangement also allows the door to be converted from a sliding door to a pivotal door, and vice versa.

19 Claims, 3 Drawing Sheets

37
62a
54
65
55
56
39
45
42
46
57
59
41
63
62
41
40
39
48
58
62b
40
49
50
44
43
38
39
51
53
78
76
35
52

37
62a
54
65
55
56
39
45
42
46
57
59
41
63
62
41
62b
74
40
40
39
77
73
69
71
43
38
39
74
72
72
75
35
52
76

FLOOR DOOR LOCK

This invention relates to a floor door lock for pivotal, swiveling, or swinging doors made of glass, metal wood, plastic, laminated materials, or the like, having an adapter fixed to the bottom side of the door, a downwardly projecting door-locking insert pin of this adapter engagable and retractable from a receiving opening in the floor beneath the floor door lock.

The principal disadvantage of known floor door locks is the risk of stumbling and/or injury due to projecting components. There is also the disadvantage of unavoidable slot openings in the floor-side area when the door is pushed away.

Moreover, known floor door locking devices do not provide the capability of alternative use of the door as a swiveling door and as a sliding door without changing the configuration of the floor door lock.

The principal object of the invention is to provide a floor door lock that avoids the disadvantages indicated above and ensures easily effected blocking of the moving insert pin arranged on the door itself, while making it possible to convert a swiveling or swing door into a sliding door without the need for complicated and time-consuming installation work.

This object is achieved for a floor door lock with adapter by providing a swiveling device within a receiver chamber of an adapter housing that blocks the insert (or locking) pin in the door-locking position.

This swiveling device preferably has a swiveling or pivotal connecting arm in operative connection with a roller holder that blocks the insert pin in the locking position with the floor door lock, and a return spring is advantageously provided for retraction of the connecting arm back into the adapter housing.

The foregoing and other objects will become more readily apparent by referring to the following detailed description and the appended drawings in which.

Figure 1:
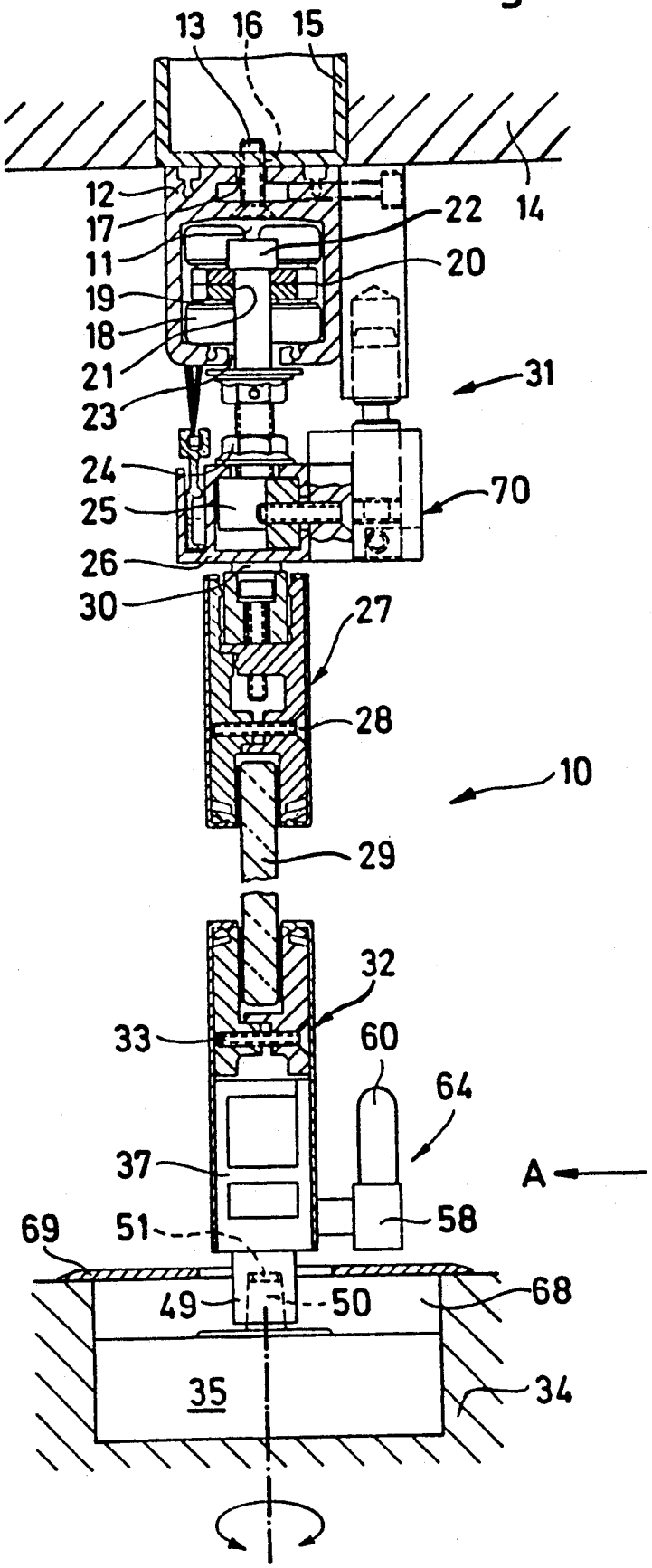
FIG. 1 is a front view of a sliding door in swiveling position, shown in section.
Figure 2:
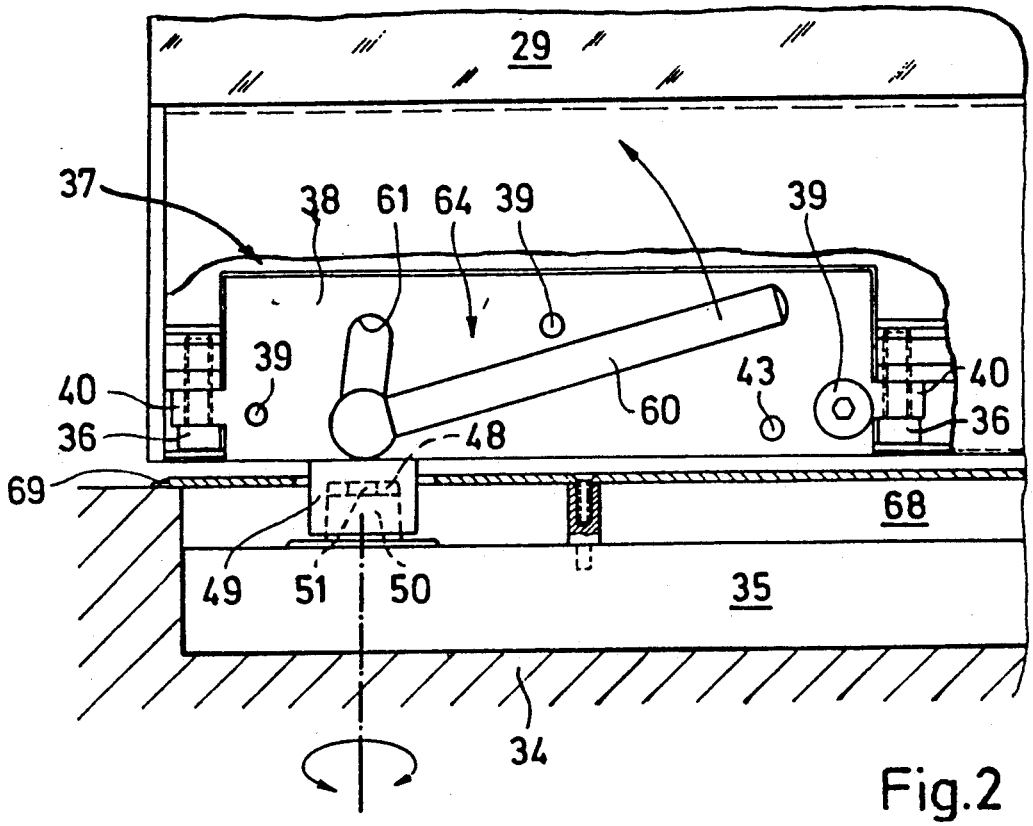
FIG. 2 is a right side view of the lower portion of the door of FIG. 1 taken along line A—A of FIG. 1.

Referring now to FIG. 1, a sliding door 10 is suspended in a sliding arrangement from a runway rail 12 having a runway 11. Runway rail 12 is fastened by means of screws 13 to a beam 15 set in a ceiling 14, the beam advantageously having tapped holes 16 for receiving and engaging screws 13. A longitudinally oriented slot opening 17 serves as the access hole for the screws 13.

The sliding door 10 can be displaced by means of guide rollers 18 arranged in the runway 11. These guide rollers 18 rotate with their axis vertical in a mounting plate 20 by means of a pivot 19, each four rollers 18 being in a square arrangement (not shown) above and below the mounting plate 20.

The upper four rollers 18 lie precisely over the bottom four rollers 18, that is, an upper roller and a bottom roller 18 always lie on a common axis.

The mounting plate 20 for the rollers 18 has a central, vertically oriented hole 21 for passage of a screw 22, the screw 22 being guided through a bottom, longitudinally oriented slot opening 23 of the runway rail 12. A nut 24 and a lock nut 25 are used to mount a rail 26 held by two screws 22 and acting as an adapter in a separable arrangement at the bottom end of the aforesaid screw 22.

The rail 26 acting as an adapter is provided for separable mounting in its bottom area of a two-part upper door rail 27, the door rail 27 being arranged to pivot around a screw, bolt 30 or the like in a fixed vertical arrangement in the rail 26. When screws 28 arranged horizontally in the door rail 27 are tightened, the two parts of the two-part door rail 27 are joined together and clamp a glass pane or plate 29 or other suitable plate or panel acting as a door. The door panel may be a single material such as wood, glass, metal, or plastic, but is often made of a combination of materials, including laminates.

The special roller suspension system described above is given only as an example. Any other roller design can be provided here to hold the sliding door 10.

The vertical turning or swiveling motion of the panel (glass pane 29) is carried out in part through a locking device 31 that is mounted in a separable arrangement on the runway rail 12 and on the rail 26.

A bottom door rail 32 forms the end of the sliding door 10 in the direction of the floor. When screws 33 arranged horizontally in the door rail 32 are tightened, the two parts of the two-part bottom door rail 32 are joined together. Thus, the glass pane 29 serving as a door panel is clamped from the bottom as well.

The glass pane 29 is joined with a door lock 35 set in the floor 34 by means of an adapter 37 separably fastened in the rail 32 on the floor-side and on the plate-side by screws 36, the adapter being flush with the door side running parallel to the floor.

The housing 38 of the adapter 37 is divided in two longitudinally and thus consists of two halves that are held together with screws 39. Parallel to the floor in the bottom area are two attachment collars 40, one on the left and one on the right, that are mounted by welding, for example, on one of the two housing halves. The collar 40 has a hole 41 through which the screws 36 can be passed for mounting the adapter 37.

When the two-part adapter housing 38 is screwed together, it forms an inner receiver 42 for a connecting arm 44 arranged there to swivel on a spindle 43, the axis of which is normal or transverse to the plane of the door panel and parallel to the floor, for a cover arm 45 mounted on the plate side by means of one of the screws 39, and for a roller holder 46 moving between the cover arm 45 and the connecting arm 44, which roller holder 46 acts as a hold-down means for the connecting arm 44 in the door-locking position.

When the sliding door 10 is in the swiveling or swing position, the connecting arm connects it with the door lock 35 set in the floor. For this purpose, the end of the connecting arm 44 turned away from the spindle 43 has a head 49 with a receiving opening 48 pointing (or opening) downward. A tapering connecting bolt 50 is inserted with its pin 78 into the receiving opening, which tapers upward. A pin 51, which can be in the form of a countersunk head screw, is loosely inserted from the top through the base of the head 49. On the other side, the connecting bolt 50 is inserted by means of a tapering pin 76 into a downwardly tapering receiving opening 52 of the door lock 35, a coaxial collar 53 arranged in the middle of the connecting bolt 50 lying against both the end face of the head 49 and the surface of the door lock 35.

The cover arm 45 is in a separable arrangement over the head 49 of the connecting arm 44. The surface of the cover arm 45 facing the inner receiver or receiver chamber 42 functions as a rolling surface 54 for the roller 55 of roller holder 46, roller 55 being arranged to rotate freely around a spindle 56 having an axis parallel to the floor. In a spaced arrangement below the spindle 56 and running parallel to the floor, the roller holder 46 has a continuous cut-out 57 which has a circle segment cross-section and into which a bolt with the same cross-section is inserted.

The bolt 58 can be made secure from unintentional removal with a retaining screw 59 and is provided with an elongated handle 60 normal hereto for better manipulation.

The two housing halves of the adapter 37 have two oblong holes 61 in alignment with each other that make full penetration from their surface. It is thus possible to insert the bolt 58 completely through an oblong hole 61 and the circle segment cut-out 57 so that the end face 67 of the bolt 58 will be flush with the surface of the other housing half. The oblong hole 61 thus serves as a positive guide for the bolt 58 when handle 60 is manipulated to bring the roller holder from an approximately vertical position (actually just beyond vertical) into an approximately horizontal position, or vice versa. This precisely establishes how the roller holder is to move within the receiver chamber 42.

When the roller holder 46 is brought from an approximately vertical position into the horizontal position, a return spring 62 articulating between the cover arm 45 and the connecting arm 44 retracts the connecting arm completely into the receiver chamber 42. In its end position, about half the length of the roller holder lies in a receiver pocket 63 formed over the head 49 with the connecting arm 44.

Figure 3:
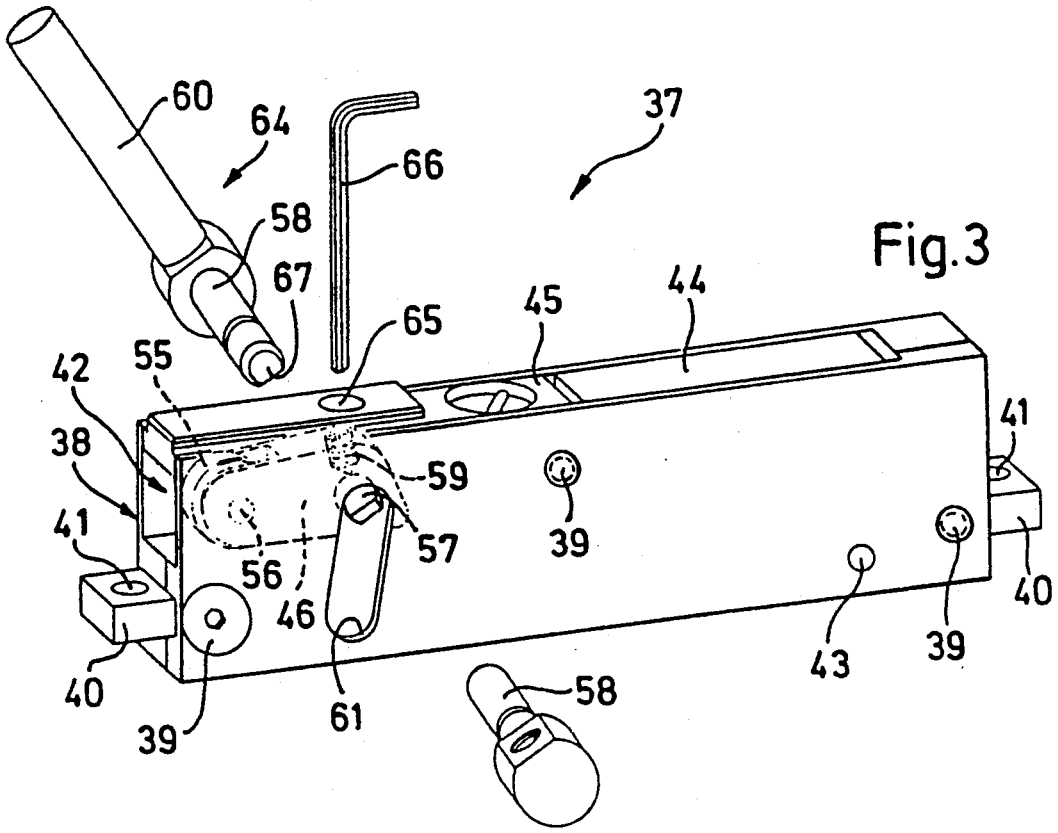
FIG. 3 is a perspective view of an adapter.

The adapter 37 can be operated from either end face. For this purpose, the roller holder 46 is moved into the horizontal position by means of the bolt 58 and the handle 60 acting as a lever 64 (see FIG. 3) so that the retaining screw 59 can be unscrewed by means of a hexagon socket wrench 66 or the like through a sight hole 65 in the upper longitudinal end face of the adapter 37. The lever 64 is pulled out of the cut-out with circle segment cross-section and reinserted on the opposite side. The end face 67 (See FIG. 3) of the bolt closes with the surface of the corresponding housing half of the adapter 37. The retaining screw 59 is tightened again through the sight hole 65 with the hexagonal socket wrench 66. The adapter 37 can thus be manipulated from the opposite side as well.

The invented adapter makes it possible to use the same door as a sliding door or as a swiveling or swing door without the need for complicated and time-consuming installation and change-over work. The change-over from swinging to sliding is carried out as follows:

The connection of the door leaf (panel) with the sliding structure on the lock side is established in the upper corner by means of a hook lock (not shown).

The door leaf is disengaged from the door lock 35 by moving the lever 64 from the bottom to the top end point. The two end points are determined here by the positive guidance of the bolt 58 in the oblong hole 61 in the side opposite the insertion side. The roller 55 of the roller holder 46 is moved over the rolling surface toward the plate side of the door. At the start of this motion, the bottom end of the roller holder 46 acts on the pin 51 so that the latter forces the connecting bolt 50 downward into the receiving opening 52 of the door lock 35. Extraction of the connecting bolt 50 from the receiving opening 52 is thus avoided because this motion counters the effort of the return spring 62 to retract the connecting arm 44 into the receiver chamber 42. As the roller 55 continues to move toward the plate side of the door, the return spring 62 continues to draw the connecting arm 44 upward. The head 49 is lifted from the connecting bolt 50 and leaves the receiver chamber 68 through a cover plate 69 covering the receiver chamber 68 in the floor 34 for the door lock 35, and is finally drawn so far into the receiver chamber 42 that it receives the connecting arm 44 in its entirety. The roller holder 46 has now assumed a position that is approximately horizontal with respect to the floor 34. The connection between the door leaf and the door lock 35 is separated.

The bottom part 70 of the locking device 31 is separated from the rail 26 and the swinging function of the door has been converted into a sliding function.

The change-over from sliding to swinging is carried out in a way that is similar to the three steps described above but in reverse order.

Figure 5:
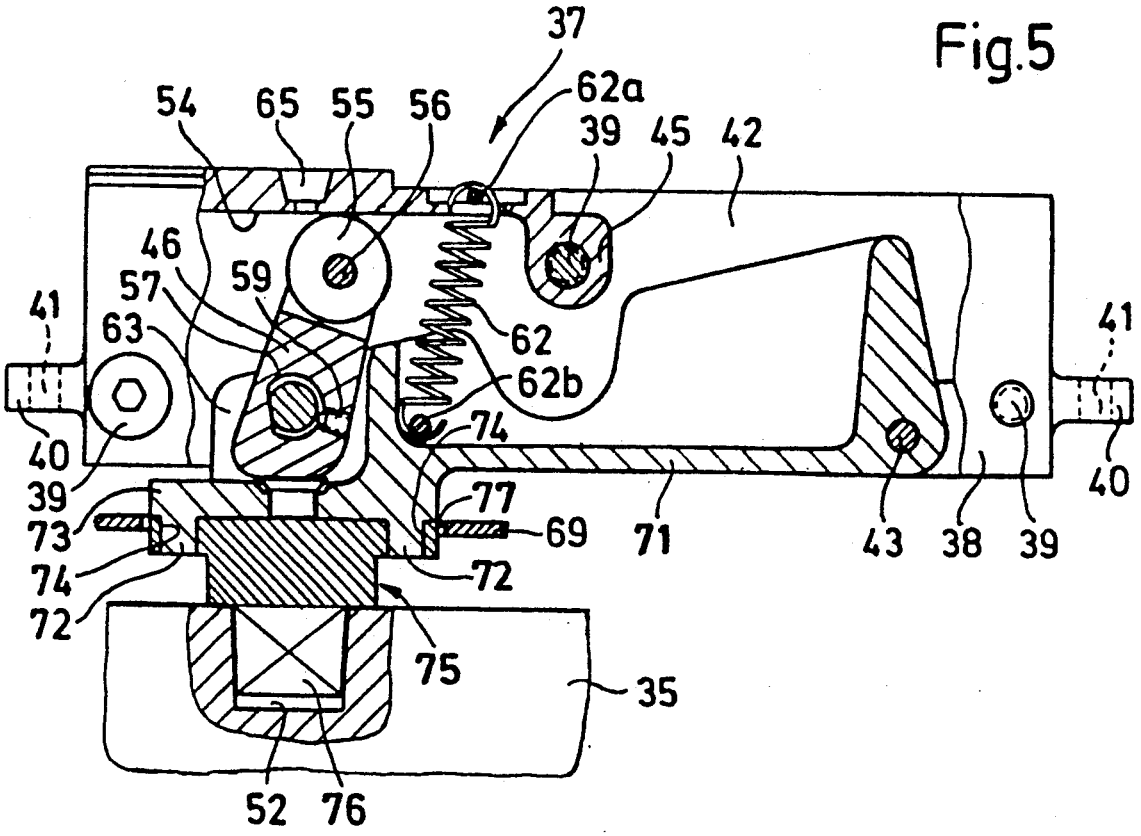
FIG. 5 is a front view, partially in section, of a modification of the adapter shown in FIG. 4.

In an alternative embodiment of the adapter according to FIG. 5, the end of connecting arm 71 turned away from spindle 43 has a head 73 with, for example, two connecting pins 72 that have a circular cylindrical cross-section. The axis of the two connecting pins 72 that can be both cylindrical and tapering is vertical to the end face of the head 73 facing and parallel with the floor 34 when the device is in the swiveling position.

The connecting pins 72 engage holes 74 in a connecting bolt 75 that connects the sliding door 10 with the door lock 35. The cover plate 69 has an aperture 77 for the connecting bolt 75; the upper end face of the connecting bolt 75 and the surface of the cover plate 69 lie at a common level.

The connecting bolt 75 engages the receiving opening 52 of the door lock 35 with its part that faces the floor 34 and is designed as a tapering pin 76.

The advantages of both embodiments is that when the sliding door is in the sliding position, the connecting arm 44 or 71 is completely retracted into the receiving chamber 42 of the adapter by the return spring 42. There are no components projecting over the surface of the cover plate 69 that covers the receiving chamber 68 for the door lock 35 because the surface of the cover plate 69 and the upper end face of the connecting bolt 50 or 75 lie on one level. The risk of tripping, stumbling, and possible injury to persons passing this area is thus avoided.

The return spring 62 is attached to two opposing studs 62a, 62b, arranged at a predetermined distance apart, on the cover plate 69 and on the connecting arm 44.

Figure 4:
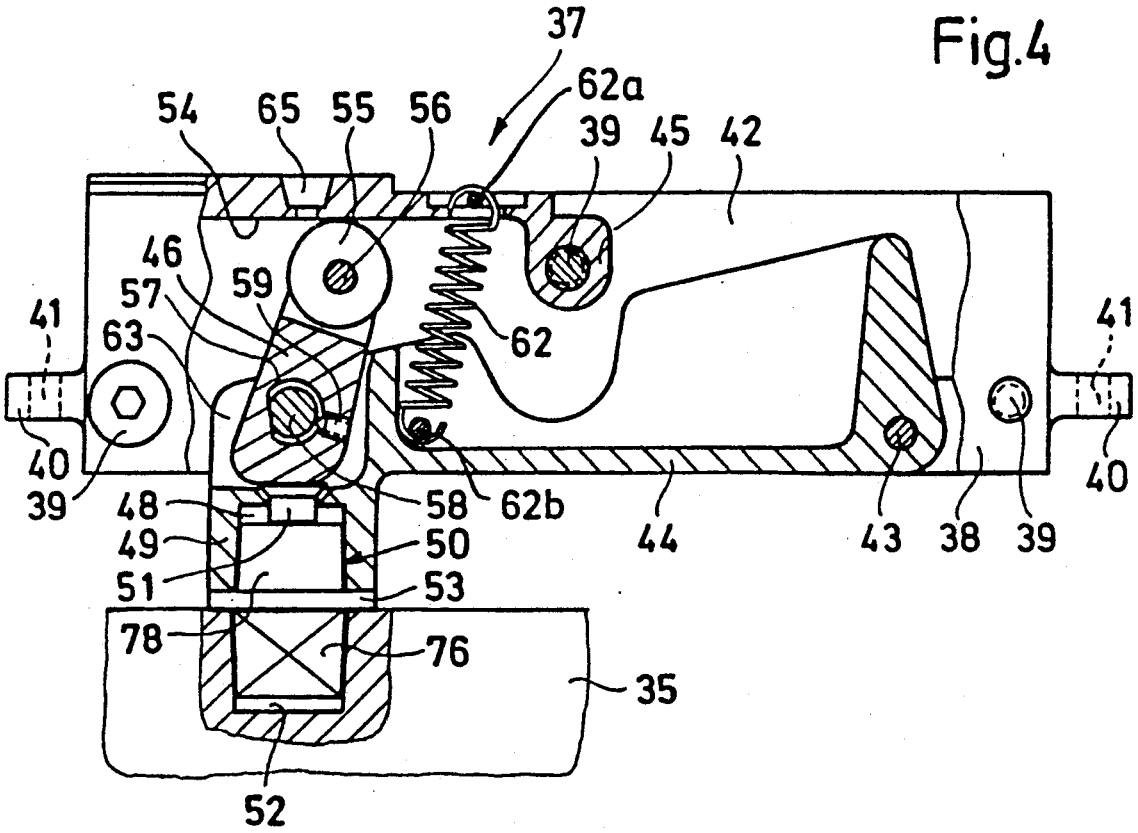
FIG. 4 is a front view, partially in section, of the adapter of FIG. 3.

The embodiment depicted in FIG. 5 also has the advantage that the head 73 does not surround the connecting bolt 75 when the sliding door is in the swiveling position and thus the aperture 77 of the cover plate 69 surrounds only the connecting bolt 75 when the door is in the sliding position. When the connecting arm 71 is drawn in, therefore, a very small gap surrounds the connecting bolt 75, the increase in size being that of the wall thickness of the head 49 in the embodiment of FIG. 4.

In accordance with the embodiments shown in the drawings, larger cut-outs in the area of the cover plate 69 are not necessary, thus minimizing or totally eliminating the risk of tripping, stumbling and injury for persons passing over this area.

What is claimed is:

1. A floor door lock for restricting movement of a pivotal or sliding door relative to a floor, said door having top and bottom sides, said floor door lock being adapted for situation within the fllor, and being provided with a pin-receiving opening therein, an adapter fixed to the bottom side of the door, the adapter carrying a downwardly extendible lock pin (76) adapted to engage said pin-receiving opening in said floor door lock, said adapter comprising an adapter housing (37, 38) forming a receiving chamber (42) therein, a pivotal arm (44) pivotally connected to said housing within said housing, said lock pin connected to said pivotal arm, and pivotal means (46) for retaining said lock pin in the door-locking position in the pin-receiving opening.

2. A floor door lock according to claim 1, wherein the pivotal or sliding door includes a vertical door panel (29), said pivital arm (44) being mounted to swivel in the receiving chamber (42) around an axis (43) which is transverse to the plane of the door panel (29).

3. A floor door lock according to claim 1, wherein said means (46) for retaining said lock pin in the door-locking position is a roller holder pivotally mounted within the adapter housing (38), and having a roller (55) at one end adapted to roll on an inner rolling surface (54) parallel to the longitudinal centerline of the adapter housing (38) while moving the pivotal arm (44) toward the receiving opening in the floor door lock (35).

4. A floor door lock according to claim 3, wherein the rolling surface (54) is provided on a cover arm (45) removably fixed in the adapter housing (38).

5. A floor door lock according to claim 3, wherein the roller holder (46) is connected to an outer swiveling hand lever (60), the handle of which is exterior of said housing (38).

6. A floor door lock according to claim 3, characterized in that the lock pin (76) is forced into the receiving opening of the floor door lock (35) by the pivotal arm (44) in operative connection with the roller holder (46) designed as a hold-down means.

7. A floor door lock according to claim 1, further comprising biasing means connected to arm (44) and said adapter housing (38), and adapted to urge said arm into said housing.

8. A floor door lock according to claim 7, wherein said biasing means is a spring (62).

9. A floor door lock according to claim 8, further comprising an outer swiveling hand lever (60) connected to the roller holder characterized in that the pivotal arm (44) is in operative connection with a return spring (62) that retracts the pivotal arm (44) into the adapter housing (38) when the roller holder (46) is released from hand lever (60) and thus withdraws the insert pin (76) from the receiving opening of the door lock (52).

10. A floor door lock according to claim 3, characterized in that the roller holder (46) is mounted to be moved by means of a hand lever (60) alternately from an approximately vertical position into a horizontal position.

11. A floor door lock according to claim 4, characterized in that the cover arm (45) is provided with an aperture (65) for access by a socket wrench (66) to a screw (59) securing the roller holder (46) to a bolt (58), whereby the hand lever (64) can be applied on either side of the adapter housing (38).

12. A floor door lock according to claim 1, characterized in that a head (73) arranged on the pivotal arm (71) is provided with at least two opposing connecting pins (72).

13. A floor door lock according to claim 12, characterized in that the connecting pins (72) engage corresponding holes (74) of a connecting bolt (75), a tapering pin (76) serving as an insertion pin that engages a corresponding receiving opening (52) of the floor door lock (35).

14. A floor door lock according to claim 5, characterized in that a bolt (58) which is connected to hand lever (60) at a right angle thereto is guided by an oblong hole (61) cut into the adapter housing (38).

15. A floor door lock according to claim 13, the connecting bolt (75) having an upper end face and the coverplate (69) having an upper flat surface, characterized in that the upper end face of the connecting bolt (75) and the upper surface of the cover plate (69) lie on a common level.

16. A floor door lock for a swiveling or swing door according to claim 1, wherein said door is made of at least one of the materials of the group comprising: glass, metal, plastic, wood, and laminated material.

17. A floor door lock for a swiveling or swing door according to claim 1, wherein said adapter is removably connected to the bottom side of said door.

18. A floor door lock for a swiveling or swing door according to claim 1, wherein said adapter is removably connected to the bottom side of the door by screws.

19. A method for converting a swinging door to a sliding door, comprising:

providing a door having a vertical door panel 29 with a lock side, an upper runway rail 26 for engagement with an overhead structure and having a separable locking device 31 engageable with the runway rail and the door, and a lower floor door lock 35 engageable with the door;

connecting the door panel to a sliding structure on the lock side;

disengaging the door panel from the floor door lock 35;

separating the connection between the door panel and the floor door lock; and separating the locking device 31 from the rail 26, whereby the swinging function of the door has been converted into a sliding function.

* * * * *